United States Patent [19]

Hannula

[11] 3,992,597

[45] Nov. 16, 1976

[54] MECHANICAL MOTION DETECTOR

[75] Inventor: Raymond H. Hannula, West Allis, Wis.

[73] Assignee: Allen-Bradley Company, Milwaukee, Wis.

[22] Filed: July 21, 1975

[21] Appl. No.: 597,691

[52] U.S. Cl. ..... 200/61.39

[51] Int. Cl.[2] ..... H01H 35/40

[58] Field of Search..... 200/61.39, 81.9, 61.86

[56] References Cited

UNITED STATES PATENTS 2,427,453 9/1947 Hadley ..... 200/61.39

3,573,405 4/1971 Skinner ..... 200/61.39

*Primary Examiner*—James R. Scott

*Attorney, Agent, or Firm*—Quarles & Brady

[57] ABSTRACT

A housing defines a fluid enclosure which contains a gear pump having a driving gear that couples for rotation by a shaft. When the shaft rotates, the gear pump forces fluid through one of two fluid passages in the housing against the force of a valve spring. A torque which remains relatively constant over a wide range of shaft speeds is thus applied to the housing, and in reaction the housing rotates to operate an electrical switch.

6 Claims, 7 Drawing Figures

Fig. 1
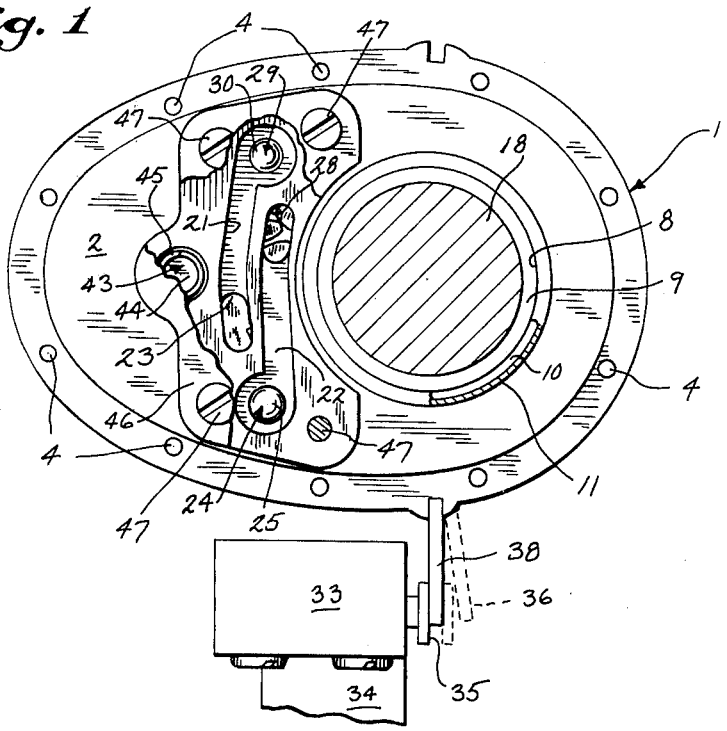
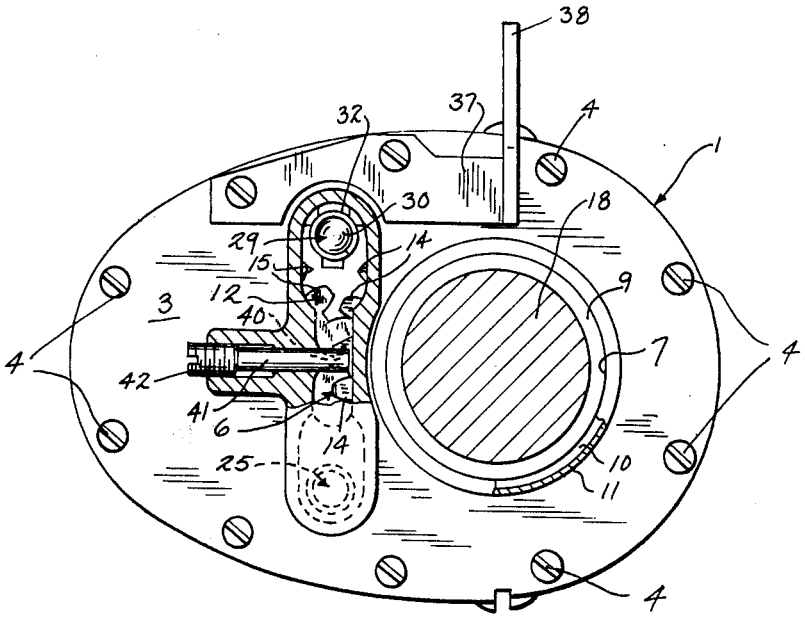
Fig. 2

Fig.3
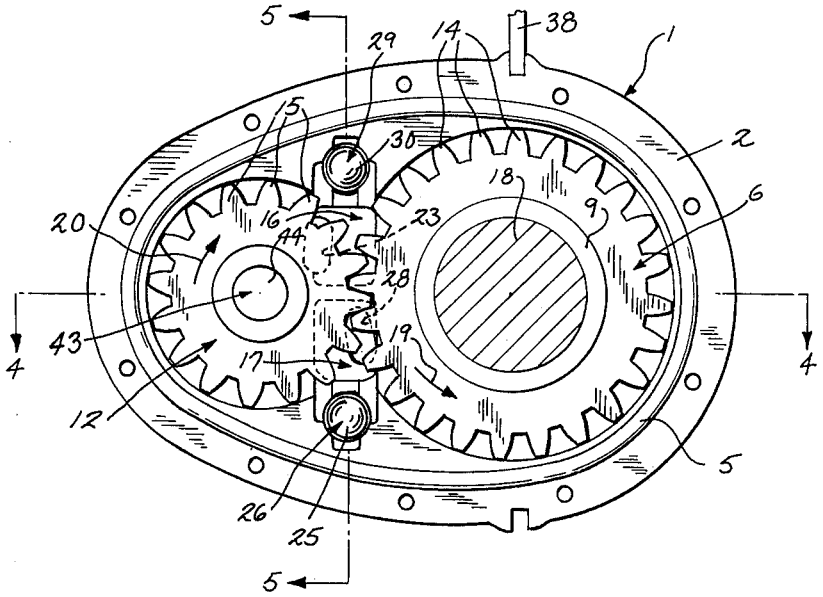
Fig.4
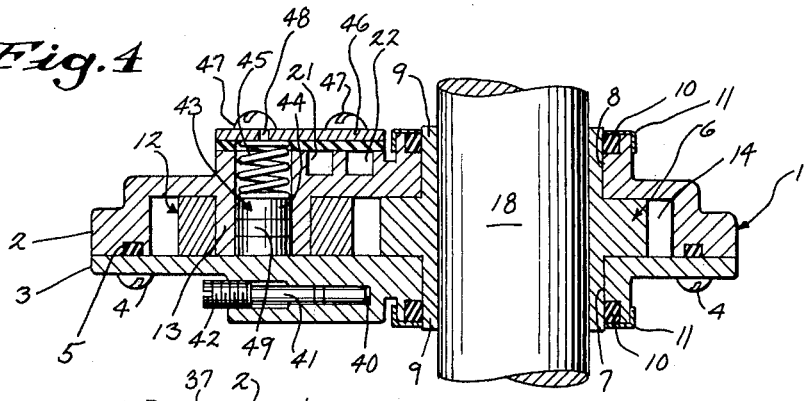
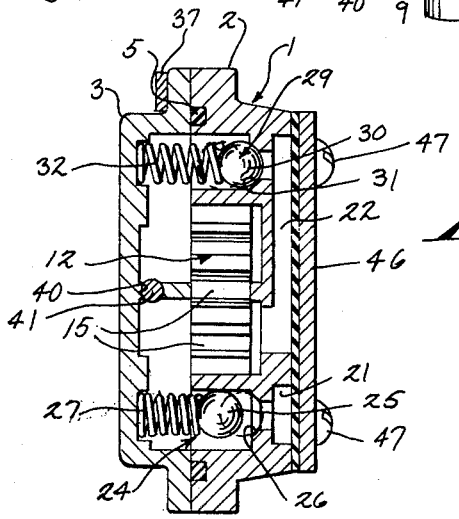
Fig.5

Fig. 6
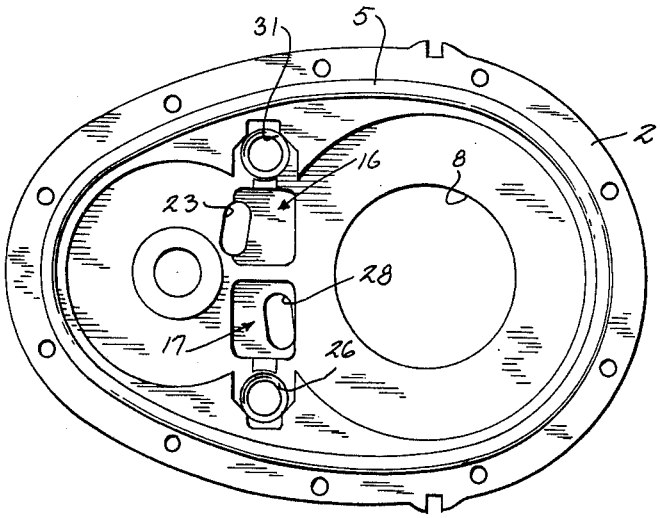
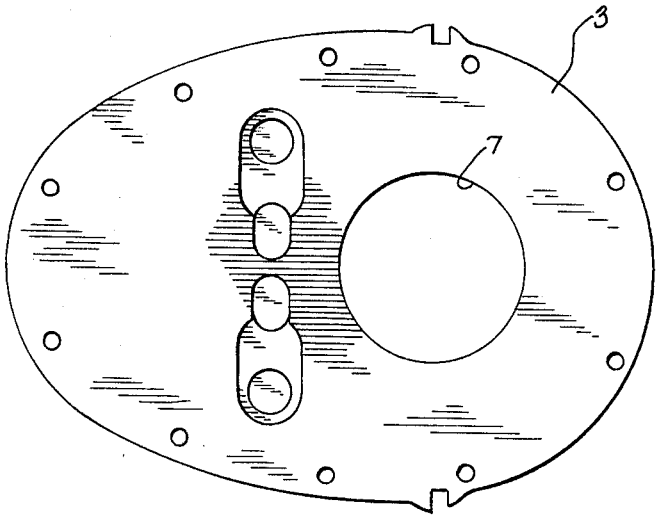
Fig. 7

MECHANICAL MOTION DETECTOR

BACKGROUND OF THE INVENTION

The field of the invention is mechanical motion detectors, and particularly, mechanical means for indicating the rotation of a shaft.

Mechanical motion detectors such as that disclosed in U.S. Pat. No. 3,573,405 include a fluid pump which is connected to a shaft and which includes an electrical switch that is responsive to the operation of the pump to open or close an electrical circuit. The shaft may couple to indicate motion of a machine such as an automobile, and the electrical switch may operate electric motors, door locks or lights.

SUMMARY OF THE INVENTION

The present invention relates to a mechanical means for sensing the motion of a shaft and operating a switch in response thereto. More specifically, the motion detector of the present invention includes a housing which defines a fluid enclosure, a driving gear disposed within the fluid enclosure and coupled for rotation by the shaft, a driven gear rotatably mounted to the housing and disposed within the fluid chamber, the driving and driven gears each having a set of teeth which sealingly engage with the walls of the enclosure and mesh with each other to form a gear pump and to define two fluid chambers, a fluid passage formed within the housing and connecting the two fluid chambers, a pressure responsive valve disposed within the fluid passage, and means mechanically coupling the housing to the switch to operate the switch in response to rotation of the housing about the shaft.

When the shaft rotates, the gears are rotated within the housing and fluid is pumped through the fluid passage from one fluid chamber to the other against the force of a spring which acts to close the valve. This spring force is reflected both as a torque on the shaft and an equal, but opposite torque on the housing which causes it to rotate into engagement with the switch. The torque applied to the housing and the resulting force thus applied to operate the switch is relatively constant for all operating speeds. When the shaft stops rotating, no torque is generated and a return spring disengages the housing from the switch.

A general object of the invention is to provide mechanical means for detecting the motion of a shaft which rotates over a wide range of speeds. The motion detector of the present invention is responsive at low shaft speeds and yet does not overheat or consume large amounts of energy when the shaft is operated continuously for long periods of time. Regardless of shaft speed, the torque imposed by the motion detector remains substantially constant, thus making it suitable for detecting the motion of machines such as presses which are continuously cycled and which display substantial changes in speed during each cycle.

Another object of the invention is to provide a mechanical motion detector which can be operated in either direction. The pressure responsive valve also operates as a check valve to allow passage of fluid only in one direction. A second fluid passage is provided in the housing and a second pressure resonsive valve is disposed therein and also operates as a check valve to allow passage of fluid in the direction opposite the first pressure responsive valve. The gear pump may thus be rotated in either direction to generate the torque needed to operate the switch.

Still another specific object of the invention is to provide means for regulating the time required to reset the switch when the shaft stops rotating. A third fluid passage is provided in the housing between the two fluid chambers and an adjustable needle valve is disposed therein and provides an adjustable constriction in this passage which controls the flow of fluid in either direction.

The foregoing and other objects and advantages of the invention will appear from the following description. In the description reference is made to the accompanying drawings which form a part hereof and in which there is shown a preferred embodiment of the invention. Such embodiment does not necessarily represent the full scope of the invention, however, and reference is made to the claims herein for interpreting the breadth of the invention.

BRIEF DESCRIPTION OF THE DRAWINGS

FIG. 1 is a front elevation view with parts cut away of the motion detector and the electrical switch which it operates, FIG. 2 is a back elevation view with parts cut away of the motion detector of FIG. 1, FIG. 3 is an elevation view of the motion detector of FIG. 2 with the cover removed, FIG. 4 is a view in cross section of the motion detector of FIG. 3 taken along the plane indicated by the line 4—4, FIG. 5 is a view in cross section of the motion detector of FIG. 3 taken along the plane indicated by the line 5—5, FIG. 6 is an elevation view of the bottom portion of the housing which forms a part of the motion detector shown in FIG. 3, and FIG. 7 is an elevation view of the top portion of the housing which forms part of the motion detector shown in FIG. 3.

DESCRIPTION OF THE PREFERRED EMBODIMENT

Referring particularly to FIGS. 1, 3, 6 and 7, the motion detector includes a housing 1 which is formed by a base 2 and a cover 3 that are cast from an aluminum alloy and are attached to one another by a set of screws 4 disposed around their perimeter. An O-ring 5 provides a seal at the juncture of the base 2 and cover 3 and a fluid enclosure is thus formed within the housing 1.

Referring particularly to FIGS. 3 and 4, a driving gear 6 is disposed within the housing 1 and is journaled between aligned openings 7 and 8 which are formed in the cover 3 and base 2. The driving gear 6 includes sleeve portions 9 which extend outwardly in both directions through the openings 7 and 8 to support the gear and to couple it with a shaft. A rubber seal 10 is received in an annular groove which is formed in the housing 1 adjacent to each end of the sleeve portions 9 and an annular retainer ring 11 fits snugly over the seals 10 to hold them in place. The driving gear 6 thus communicates with the exterior of the housing 1 through the openings 7 and 8 and it is journaled for rotation within the housing 1.

A driven gear 12 is also rotatably mounted within the housing 1 and together with the driving gear 6 form a gear pump. More specifically, an annular sleeve 13 is integrally formed on the base 2 and extends toward the cover 3. The driven gear 12 is supported by the sleeve 13 and it rotates thereabout in the same plane as the driving gear 6. The driving gear 6 has a set of teeth 14 disposed around its circumference which mate with a similar set of teeth 15 that are formed around the circumference of the driven gear 12. The interior of the housing 1 is contoured to sealingly engage the outer surfaces on the teeth 14 and 15 over a substantial portion of their circumference. The point at which the teeth 14 and 15 mesh with one another divides the fluid enclosure into a first fluid chamber indicated generally at 16 and a second fluid chamber indicated generally at 17.

The housing 1 is mounted to a shaft 18 by inserting the shaft 18 through the opening which extends transversely through the driving gear 6 and its associated sleeve portions 9. The driving gear 6 is thus coupled to the shaft 18 and when the housing 1 is restrained against rotation the shaft 18 drives the gear pump. The fluid enclosure is filled with a high viscosity index fluid such as silicone hydraulic fluid and when the driving gear 6 is rotated in the counter-clockwise direction as indicated by the vector 19, the driven gear 12 is rotated in the clockwise direction as indicated by the vector 20. Fluid is carried in the pockets formed between the gear teeth 14 and 15 and the walls of the housing 1 from the second fluid chamber 17 to the first fluid chamber 16. If the shaft 18 rotates in the opposite direction, the fluid pump operates in reverse to pump fluid from the first fluid chamber 16 to the second fluid chamber 17.

Referring to FIGS. 1, 4, 5 and 6, the fluid chambers 16 and 17 are connected together by a pair of fluid passages 21 and 22 which are formed in the base 2. The fluid passage 21 communicates with the first fluid chamber 16 through a fluid inlet 23 and it communicates with the second fluid chamber 17 through a first valve 24. The valve 24 includes a ball 25 which is biased against a valve seat 26 by a spring 27 to form a pressure responsive valve to fluid flow in one direction and a check valve to fluid flow in the other direction. When the shaft 18 rotates in excess of 5 rpm in the direction indicated by the vector 19, the pressure in the first fluid chamber 16 increases above that in the second fluid chamber 17 and the ball 25 is unseated to allow the flow of fluid through the first fluid passage 21. Similarly, the second fluid passage 22 communicates with the second fluid chamber 17 through a second fluid inlet 28 and it communicates with the first fluid chamber 16 through a second valve 29. The second valve 29 includes a ball 30 which is biased against a valve seat 31 by a spring 32 and when the driving gear 6 is rotated in the direction opposite the vector 19, the second check valve 29 is opened against the force of the spring 32 and fluid flows from the second fluid chamber 17 to the first fluid chamber 16 through the second fluid passage 22.

Referring particularly to FIG. 1, the housing 1 is supported by the shaft 18 and a snap action switch 33 is mounted adjacent thereto on stationary framework 34. The switch 33 includes a plunger 35 which is mounted for sliding motion between a depressed, or actuated, position and a released, or unactuated position A spring (not shown in the drawings) contained within the switch 33 biases the plunger in its unactuated position indicated by the dashed lines 36. An operating bracket 37 is mounted to the motion detector housing 1, as shown in FIG. 2, and it includes an operating arm 38 which extends radially outward to engage the end of the plunger 35. When the shaft 18 rotates, it applies a torque to the housing 1 to overcome the impedance of the gear pump, and this torque swings the operating arm 38 against the plunger 35. The switch 33 requires a force of approximately three pounds to operate the plunger 35, and this is reached at a shaft speed of approximately 15 rpm. The force which is exerted by the operating arm 38 increases very sharply between zero and 20 rpm to a value of approximately 5 pounds and then it levels off substantially at higher speeds, reaching a value of approximately eight pounds at 240 rpm. Thus, the actuating force generated by the motion detector reaches a substantial level at relatively low shaft speeds and increases only slightly above this level at higher shaft speeds. The motion detector is, therefore, responsive at relatively low shaft speeds, but is not required to dissipate large amounts of energy in the form of heat at high shaft speeds.

When the speed of the shaft 18 drops below 5 rpm, the force applied to the switch 33 must drop sharply in order that the switch 33 will drop out within a reasonable time. Referring particularly to FIGS. 2 and 4, to provide this rapid dropout response a third fluid passage 40 is formed in the cover portion 3 of the housing 1 and couples the fluid chambers 16 and 17. The third fluid passage 40 bypasses, or shunts, the valves 24 and 29 and it serves to dissipate the pressure differential in the fluid chambers 16 and 17 which remains after the valve 24 or 29 closes. The amount of fluid allowed to pass through the passage 40 is restricted by an adjustable needle valve 41 which extends into the passage 40 and which includes a threaded operating end 42 that is received in a threaded opening formed in the cover 3. By rotating the operating end 42 with a srewdriver or similar tool, the position of the needle valve 41 within the fluid passage 40 may be adjusted and the fluid flow therethrough precisely controlled. It should be apparent that by opening the needle valve 41 the dropout response of the motion detector can be enhanced to provide the desired results. It should also be apparent, however, that a corresponding deterioration of the pickup response of the switch 33 will result and, therefore, a compromise must be made. A dropout response of less that 50 milliseconds has proven to be quite satisfactory when the motion detector is applied to a punch press control.

During continuous operation of the motion detector as, for example on a punch press, its temperature rises and the fluid within the housing 1 expands. Referring to FIGS. 3 and 4, an expansion valve 43 is provided to accommodate this change in volume. The expansion valve 43 is disposed within the sleeve 13 that supports the driven gear 12 and it includes a circular cylindrical piston 44 which is slidably received within the sleeve 13. A spring 45 is also positioned above the piston 44 and it provides a force which drives the piston 44 against the cover 3. A plate 46 is held in place over the spring 45 by a set of srews 47 and a vent 48 is formed therethrough to allow free movement of the piston 44 and to provide an atmospheric reference. An O-ring 49 is received in a recess formed around the perimeter of the piston 44 to provide a fluid seal. A gasket 50 is sandwiched between the plate 46 and the base 2 to provide a fluid seal for the fluid passages 21 and 22.

When the fluid within the housing 1 expands during operation of the motion detector, fluid enters the circular cavity within the sleeve 13 and lifts the piston 44 away from the cover 3. When the fluid cools and contracts, the spring 45 forces the piston 44 toward the cover 3 and any fluid within the sleeve 13 is forced back into the fluid chambers 16 and 17.

It should be apparent that the preferred embodiment of the motion detector described herein is adapted for operation in either direction. The operating bracket 37 may be mounted to either side of the shaft 18. Also, the fluid pump formed by the gears 6 and 12 may be driven in either direction, in which case either the first fluid passage 21 or second fluid passage 22 and their associated valve 24 or 29 will be operable. The needle valve 41 and expansion valve 43 are also bidirectional.

It should be apparent to those skilled in the art that a number of variations can be made in the above described structure without departing from the spirit of the invention. For example, an additional return spring may be added to supplement that contained within the switch 33. Also, the shaft 18 need not pass completely through the housing 1, but may instead, couple to the driving gear 6 through an opening in one side of the housing or the other. Also, a number of mechanical arrangements for coupling the rotational motion of the case to the operation of the switch 33 are possible.

I claim:

1. A mechanical motion detector for operating a switch in response to the rotation of a shaft, the combination comprising:

a housing which defines a fluid enclosure;

a driving gear disposed within said fluid enclosure and mounted for rotation therein, said driving gear being coupled for rotation by said shaft;

a driven gear rotatably supported by said housing and disposed within said fluid enclosure, said driving and driven gears each having teeth disposed around its circumference which sealingly engage with the walls of the fluid enclosure and which mesh with each other to define two fluid chambers;

a fluid passage formed in said housing and having an inlet to one of said fluid chambers and an outlet to the other fluid chamber;

a pressure responsive valve disposed within said fluid passage and including a spring which generates a force that closes the valve to the flow of fluid through said fluid passage; and means coupling the housing with the switch for operating the switch when the housing rotates.

2. The mechanical motion detector as recited in claim 1 in which said driving gear includes a sleeve portion which extends through an opening in said housing to connect with said shaft and said housing is supported by this connection to the shaft for rotation thereabout.

3. The mechanical motion detector as recited in claim 2 in which said coupling means includes an operating arm which is mounted to the housing and extends outward therefrom to engage said switch when said housing rotates about said shaft.

4. The mechanical motion detector as recited in claim 1 in which said valve also acts as a first check valve that prevents the flow of fluid between said fluid chambers through said fluid passage in one direction, in which a second fluid passage is formed in said housing between said fluid chambers, and in which a second pressure responsive valve is disposed in said second fluid passage to prevent the flow of fluid between said fluid chambers through said second fluid passage in the other direction.

5. The mechanical motion detector as recited in claim 4 in which a third fluid passage is formed in said housing between said fluid chambers and a needle valve is disposed therein and adjustable from the exterior of said housing to control the amount of fluid which flows in said third fluid passage.

6. The mechanical motion detector as recited in claim 4 in which an expansion valve is mounted in said housing, said expansion valve including a cylindrical cavity which communicates with the interior and exterior of said housing, a piston which rides in said cavity and mates with the walls thereof to provide a fluid seal therewith, and a spring disposed within the cavity and operable to urge said piston towards the end of said cavity which communicates with the interior of said housing.

* * * * *